US012714249B2

(12) United States Patent
Earegood et al.

(10) Patent No.: US 12,714,249 B2
(45) Date of Patent: Aug. 25, 2026

(54) TOOL ASSEMBLY FOR INSTALLING CARPET BETWEEN NON-PARALLEL WALLS AND METHOD OF USING SAME

(71) Applicants: Harold W. Earegood, Clio, MI (US); Thomas A. Worthing, Clio, MI (US)

(72) Inventors: Harold W. Earegood, Clio, MI (US); Thomas A. Worthing, Clio, MI (US)

( * ) Notice: Subject to any disclaimer, the term of this patent is extended or adjusted under 35 U.S.C. 154(b) by 811 days.

(21) Appl. No.: 18/131,604

(22) Filed: Apr. 6, 2023

(65) Prior Publication Data

US 2024/0335055 A1 Oct. 10, 2024

(51) Int. Cl.
*A47G 27/04* (2006.01)

(52) U.S. Cl.
CPC ..... *A47G 27/0493* (2013.01); *A47G 27/0437* (2013.01)

(58) Field of Classification Search
CPC ..... A47G 27/0437; A47G 27/0493
USPC ..... 294/8.6
See application file for complete search history.

(56) References Cited

U.S. PATENT DOCUMENTS 761,127 A * 5/1904 Andres ..... A47G 27/0493 254/206
3,706,440 A * 12/1972 Ross ..... A47G 27/0493 294/8.6
3,745,598 A 7/1973 Krell
3,752,440 A * 8/1973 Ream ..... A47G 27/0493 294/8.6
4,084,787 A 4/1978 Kowalczyk
4,745,830 A 5/1988 Gulino
4,934,658 A * 6/1990 Berg ..... F16B 7/105 248/408
5,183,238 A * 2/1993 Sorensen ..... A47G 27/0493 294/8.6
5,484,136 A 1/1996 Lopes et al.
5,681,031 A * 10/1997 Foley ..... A47G 27/0493 254/209
5,855,361 A * 1/1999 Krowchak ..... B25B 25/00 254/209
5,984,274 A * 11/1999 Medwin ..... A47G 27/0493 254/200
6,073,328 A 6/2000 Hendricks
6,994,323 B2 * 2/2006 Carbajal ..... A47G 27/0493 254/206
7,735,148 B1 6/2010 Turman
8,757,595 B2 * 6/2014 Garzanelli ..... A47G 27/0493 254/210
9,833,096 B2 * 12/2017 Sorbin ..... A47G 27/0493
11,998,130 B2 * 6/2024 Ruiz Ruiz ..... A47G 27/06
2011/0068310 A1 3/2011 Despins et al.
2013/0187397 A1 7/2013 Despins et al.

* cited by examiner

*Primary Examiner* — Thomas E Lazo
(74) *Attorney, Agent, or Firm* — RMCK Law Group PLC

(57) ABSTRACT

A carpet installation tool assembly configured to stretch carpet between two non-parallel walls is provided. The carpet installation tool assembly comprises a first leg positioning assembly, a second leg positioning assembly, a central frame member, and a hinge arm tool. The carpet installation tool assembly can be used to stretch carpet to minimize waves and bunching during installation of carpet in rooms that are not square.

15 Claims, 5 Drawing Sheets

TOOL ASSEMBLY FOR INSTALLING CARPET BETWEEN NON-PARALLEL WALLS AND METHOD OF USING SAME

FIELD

The present disclosure relates generally to tools for installing carpet onto a floor and more particularly to a tool assembly for installing carpet between non-parallel walls a related method for making the same.

BACKGROUND

A successful carpet installation onto a floor typically requires the carpet to be evenly stretched across its length and width to avoid wavy areas. Many techniques have been used to stretch the carpet to achieve a tight profile across the entire floor. Typically a first side of the carpet is fixed to the floor such as to tack strips along a first wall. In some examples this first side of carpet can be additionally pulled toward the first wall with a supplemental tool such as a knee kicker tool or hinge arm tool. The process can be repeated around the remaining walls.

While such tools and techniques are generally adequate for installation on rooms that are square, properly stretching carpet during installation in rooms where opposite walls are not parallel poses challenges. For example, it can be difficult to adequately and evenly distribute the proper tension onto the carpet to minimize wavy areas.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A carpet installation tool assembly configured to stretch carpet between two non-parallel walls is provided. The carpet installation tool assembly comprises a first leg positioning assembly, a second leg positioning assembly, a central frame member, and a hinge arm tool. The first leg positioning assembly includes a first tube support assembly having a first tube and a second tube, wherein one of the first and second tubes moves axially relative to the other of the first and second tubes during a locating step. A first angled wall engaging assembly is pivotally coupled to the first tube support assembly and is configured to engage the angled wall during a carpet stretching event. The second leg positioning assembly includes a second tube support assembly having a third tube and a fourth tube, wherein one of the third and fourth tubes moves axially relative to the other of the third and fourth tubes during a locating step.

A second angled wall engaging assembly is pivotally coupled to the second tube support assembly and that is configured to engage the angled wall during a carpet stretching event. The first and second leg positioning assemblies are selectively coupled to the central frame member. The hinge arm tool includes a pivot arm, a foot and a carpet pad. The foot is arranged at a first end and positions against the central frame member and a carpet pad arranged at an opposite end that engages carpet near the straight wall. The hinge arm tool has a telescoping leg assembly that creates opposing forces onto the central frame member and the carpet pad upon actuation of the pivot arm. Actuation of the pivot arm creates (i) a plurality of first carpet forces along and toward the angled wall proximate the first and second angled wall engaging assembly and (ii) a plurality of second carpet forces along and toward the straight wall proximate the carpet pad thereby distributing a carpet stretching action across the carpet between the angled and straight walls.

In additional examples, the carpet installation tool assembly includes a first torque applying assembly having a first end selectively coupled to the central frame and a second end selectively coupled to the first angled wall engaging assembly, the first torque applying assembly applying tension between the central frame and the first angled wall engaging assembly urging a rotating action of the first angled wall engaging assembly into the angled wall.

In additional examples, the carpet installation tool assembly includes a second torque applying assembly having a first end selectively coupled to the central frame and a second end selectively coupled to the second angled wall engaging assembly, the second torque applying assembly applying tension between the central frame and the second angled wall engaging assembly urging a rotating action of the second angled wall engaging assembly into the angled wall.

In examples, the first tube support assembly further comprises a first locking collar that selectively locks the first and second tubes from axially moving relative to each other. The second tube support assembly further comprises a second locking collar that selectively locks the third and fourth tubes from axially moving relative to each other.

The carpet installation tool can further include a first lateral support block assembly that includes a first gripping block and a second gripping block configured to position laterally against the first tube support assembly and inhibit lateral movement of the first tube support assembly, the first and second gripping blocks each having carpet engaging protrusions on a bottom face configured to grip the carpet. A second lateral support block assembly includes a third gripping block and a fourth gripping block configured to position laterally against the second tube support assembly and inhibit lateral movement of the second tube support assembly, the third and fourth gripping blocks each having carpet engaging protrusions on a bottom face configured to grip the carpet.

In examples, the first angled wall engaging assembly includes a first support frame rigidly affixed to a first bumper, the first support frame comprising a plurality of attachment points along a length thereof, wherein the first tube support assembly is selectively coupled to one of the attachment points. In examples, the second support frame can include a C-frame. The central frame member can comprise a C-frame having a plurality of attachment points along a length thereof. The first tube support assembly is coupled to a first attachment point of the plurality of attachment points and wherein the second tube support assembly is coupled to a second attachment point of the plurality of attachment points. A foot of the hinge arm tool is positioned along the central frame at an intermediate position between the first and second tube support assemblies.

BRIEF DESCRIPTION OF THE DRAWINGS

The present disclosure will become more fully understood from the detailed description and the accompanying drawings, wherein.

DETAILED DESCRIPTION

As will become appreciated from the following discussion, the present disclosure provides a carpet installation tool assembly that can be used to stretch carpet to minimize waves and bunching during installation of carpet in rooms that are not square. As noted above, in prior art examples, it is challenging to properly account for distribution of stretching forces between walls that are not parallel. In this regard, the carpet installation tool assembly according to the present disclosure distributes load toward the generally opposing, non-parallel walls more evenly while stretching the carpet to successfully remove waves to achieve a tight carpet profile across the entire carpet surface in the room.

Figure 1:
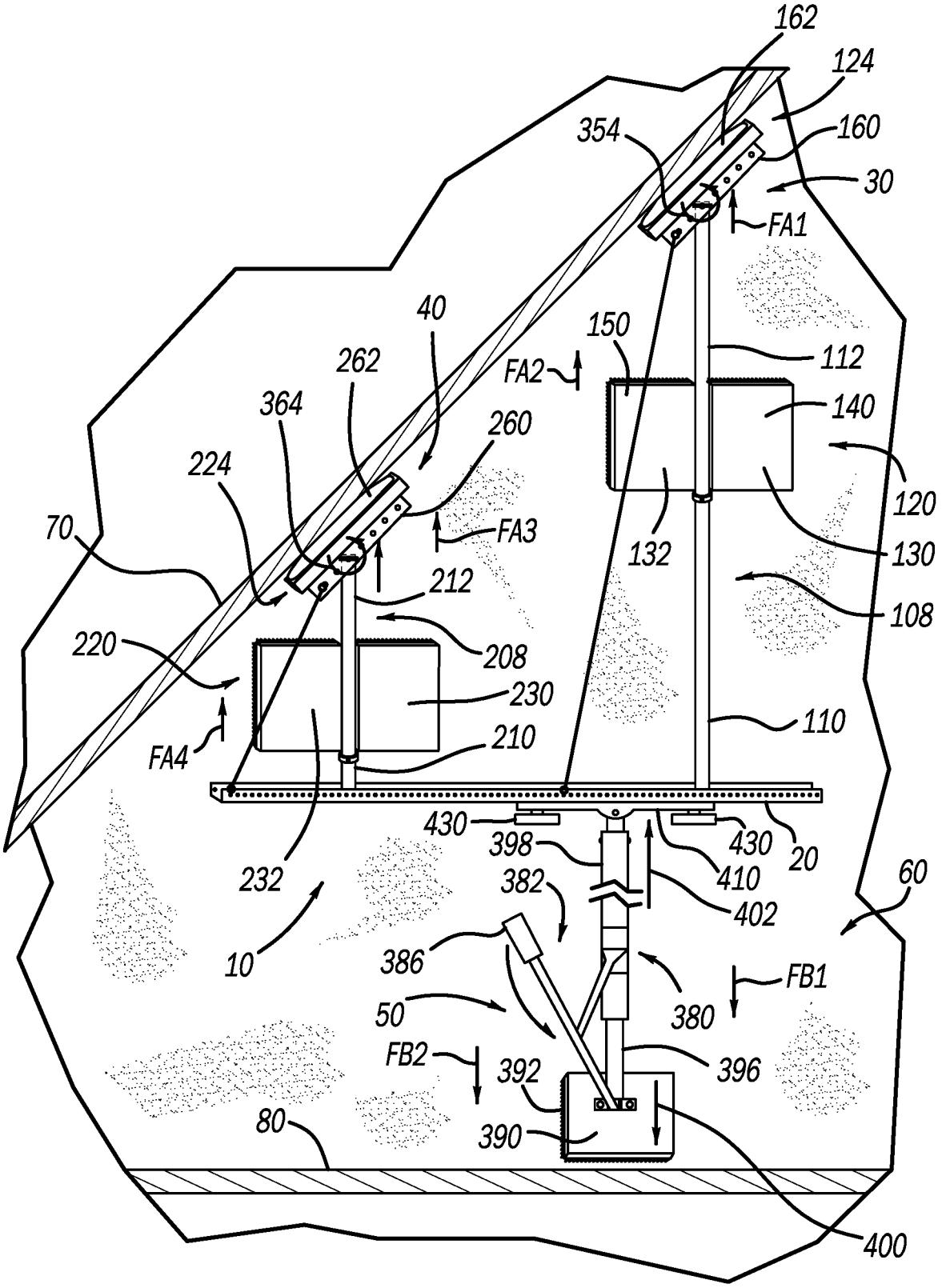
FIG. 1 is a top view of a carpet installation tool assembly shown during installation onto a floor in a room having unparallel opposing walls and shown at a first area for stretching carpet at a first location.

With initial reference now to FIG. 1, a carpet installation tool assembly constructed in accordance to one example of the present disclosure is shown and generally identified at reference numeral 10. The carpet installation tool assembly generally includes a central frame member 20, a first leg positioning assembly 30, a second leg positioning assembly 40 and a hinge arm tool 50. As will be described herein, the carpet installation tool assembly 10 can be used to stretch carpet 60 between a first wall 70 and a second wall 80. For the purposes of this discussion, the first wall 70 will be referred to an angled wall while the second wall 80 will be referred to as the straight wall. In will be appreciated however, that the first and second walls 70 and are generally offset relative to each other in a non-parallel fashion. In other words, the first and second walls 70 and 80 can have axes that define an angle therebetween. While the first and second walls 70 and 80 are shown as having about a 40-60 degree angle therebetween, it is appreciated that the carpet installation tool assembly 10 can be used to successfully stretch carpet during installation to any generally opposing walls including walls that are angled relative to each other. Further, while the carpet installation tool assembly 10 is particularly advantageous for installing carpet between angled walls, the carpet installation tool assembly 10 can similarly be used to aid in installation of carpet between parallel walls.

Figure 3:
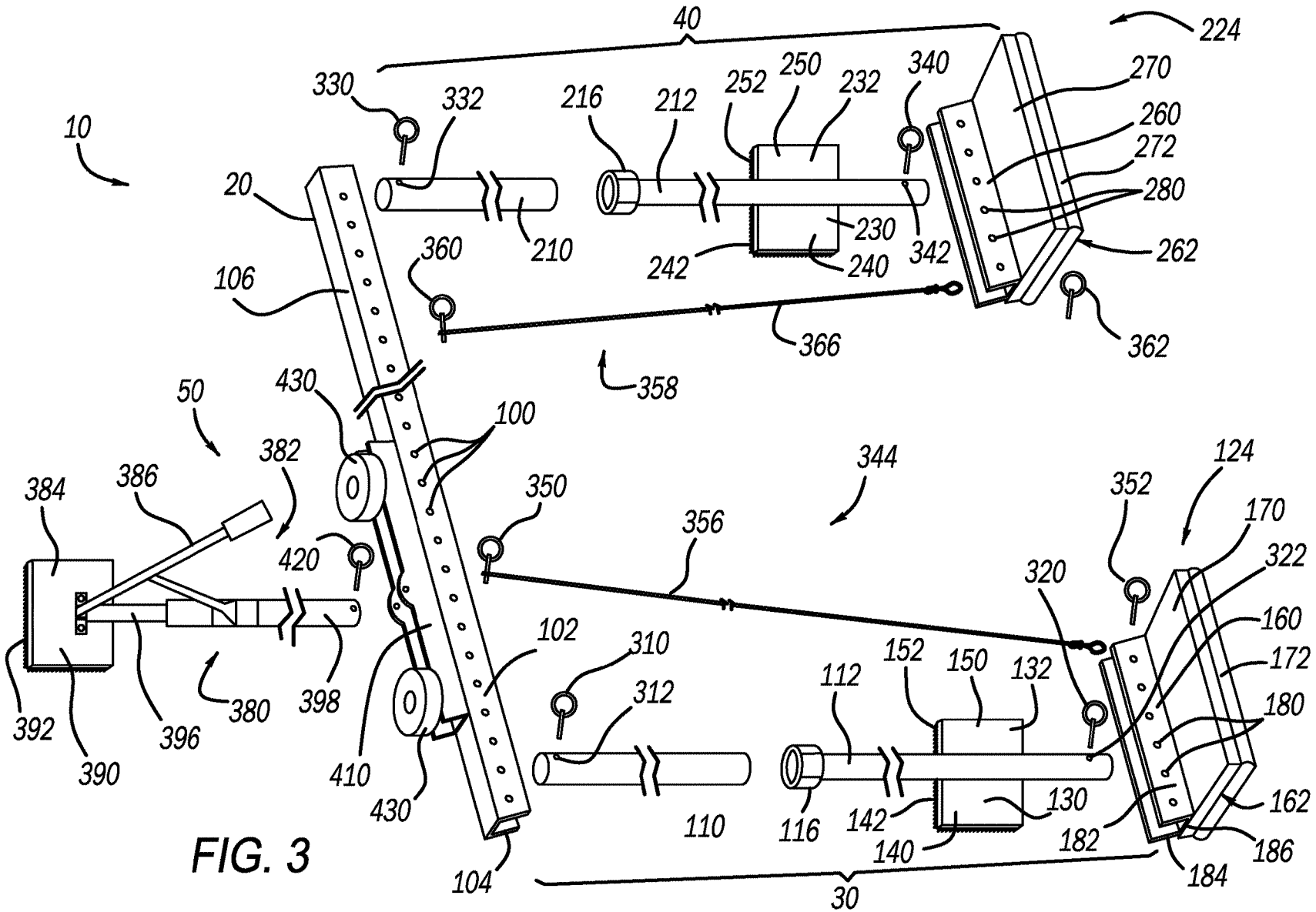
FIG. 3 is an exploded perspective view of the carpet installation tool assembly of FIG. 1 constructed in accordance to one example of the present disclosure.
Figure 4:
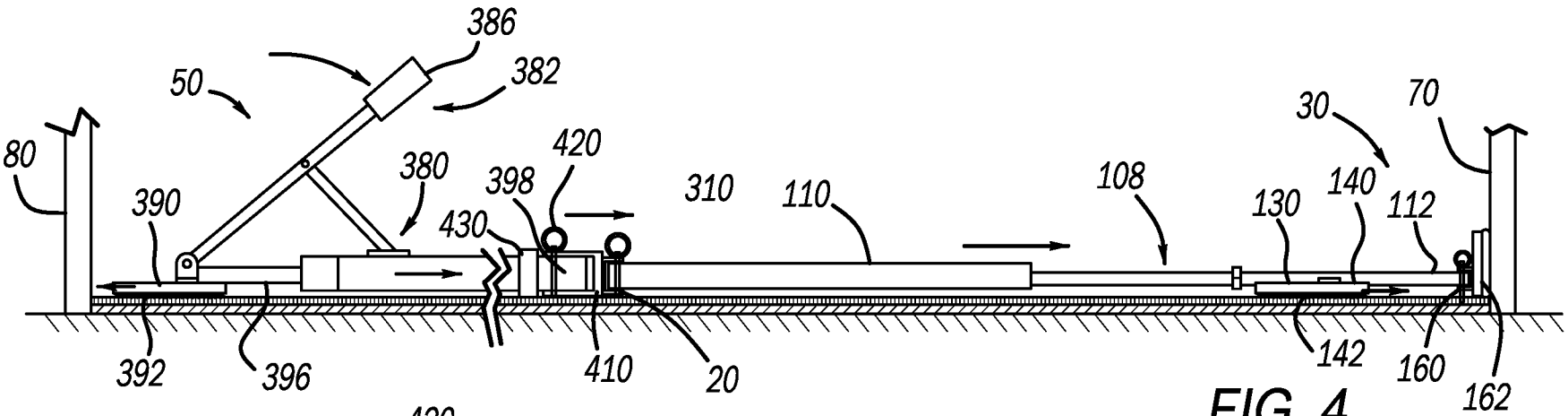
FIG. 4 is a side view of the carpet installation tool assembly shown with the first leg positioning assembly distributing a force against the first angled wall engaging assembly toward the angled wall while the hinge arm tool stretches a portion of the carpet along the opposite straight wall thereby tightening a length of carpet between the angled and straight walls.
Figure 5:
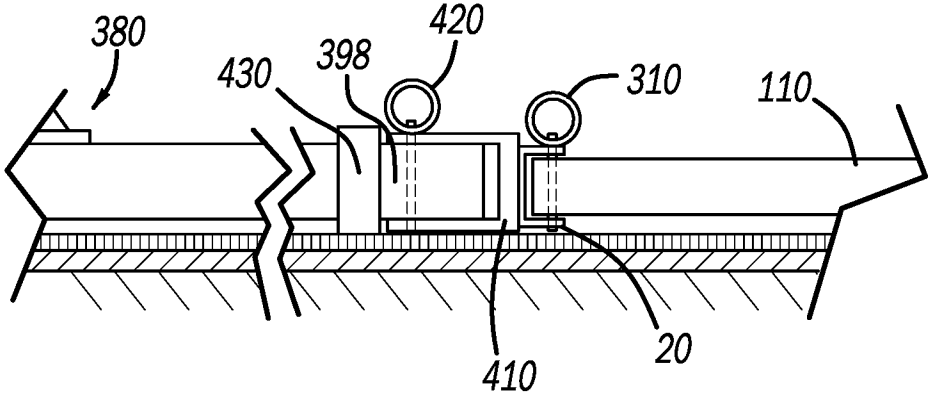
FIG. 5 is a detailed side view of a central frame member during the stretching step illustrated in FIG. 4.
Figure 6:
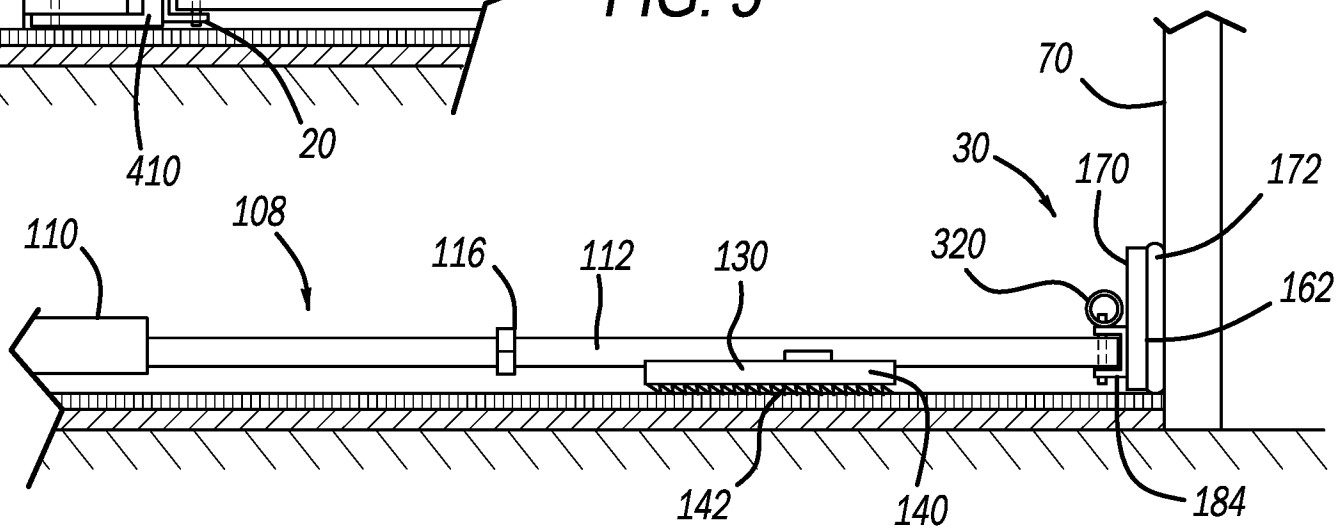
FIG. 6 is a detailed side view of a first lateral support block assembly and the first angled wall engaging assembly during the stretching step in FIG. 4.

With continued reference to FIG. 1 and additional reference to FIGS. 3-5, the carpet installation tool 10 will be further described. The central frame member 20 generally includes a rigid frame member having a plurality of attachment points, collectively identified at reference 100, along its length. In the example provided, the central frame member 20 is constructed as a c-frame having the attachment points 100 defined through parallel walls 102, 104 that generally extend from a central wall 106.

The first leg positioning assembly 30 includes a first tube support assembly 108 having a first tube 110, a second tube 112, and a first locking collar 116. The first leg positioning assembly 30 further includes a first lateral support block assembly 120 and a first angled wall engaging assembly 124. The first lateral support block assembly 120 includes a first gripping block 130 and a second gripping block 132. The first block 130 includes a rigid block member 140 having carpet engaging protrusions 142 on a bottom face that are configured to grip the carpet 60. The second block 132 includes a rigid block member 150 having carpet engaging protrusions 152 on a bottom face that are configured to grip the carpet 60. The gripping blocks 130 and 132 are placed laterally opposite the first tube support assembly 108 (at any location along its distance) and grip the carpet 60 while inhibiting lateral movement of the first tube support assembly 108 during use.

The first angled wall engaging assembly 124 generally includes a first support frame 160 rigidly affixed to a bumper 162. In examples, the bumper 162 can generally include a rigid support structure 170 and padded wall engaging portion 172. The first support frame 160 generally includes a rigid frame member having a plurality of attachment points, collectively identified at reference 180, along its length. In the example provided, the first support frame 160 is constructed as a c-frame having attachment points 180 defined through parallel walls 182, 184 that generally extend from a central wall 186.

The second leg positioning assembly 40 includes a second tube support assembly 208 having a third tube 210, a fourth tube 212, and a second locking collar 216. The second leg positioning assembly 40 further includes a first lateral support block assembly 220 and a second angled wall engaging assembly 224. The first lateral support block assembly 220 includes a third gripping block 230 and a fourth gripping block 232. The third block 230 includes a rigid block member 240 having carpet engaging protrusions 242 on a bottom face that are configured to grip the carpet 60. The fourth block 232 includes a rigid block member 250 having carpet engaging protrusions 252 on a bottom face that are configured to grip the carpet 60. The gripping blocks 230 and 232 are placed laterally opposite the second tube support assembly 208 (at any location along its distance) and grip the carpet 60 while inhibiting lateral movement of the second tube support assembly 208 during use.

The second angled wall engaging assembly 224 generally includes a second support frame 260 rigidly affixed to a bumper 262. In examples, the bumper 262 can generally include a rigid support structure 270 and padded wall engaging portion 272. The second support frame 260 generally includes a rigid frame member having a plurality of attachment points, collectively identified at reference 280, along its length. In the example provided, the first support frame 260 is constructed as a c-frame having the attachment points 280 defined through parallel walls 282, 284 that generally extend from a central wall 286.

A first pin 310 can selectively couple the first tube 110 to the central frame member 20. In particular, the first pin 310 can locate through a desired attachment point 100 along the central frame member 20 and through a bore 312 defined in the first tube 110. A second pin 320 can selectively couple the second tube 112 to the first support frame 160. In particular, the second pin 320 can locate through a desired attachment point 180 along the first support frame 160 and through a bore 322 defined in the second tube 112.

A third pin 330 can selectively couple the third tube 210 to the central frame member 20. In particular, the third pin 330 can locate through a desired attachment point 100 along the central frame member 20 and through a bore 332 defined in the third tube 210. A fourth pin 340 can selectively couple the fourth tube 212 to the second support frame 260. In particular, the fourth pin 340 can locate through a desired attachment point 280 along the first support frame 260 and through a bore 342 defined in the fourth tube 212.

A first torque applying assembly 344 includes a fifth pin 350, a sixth pin 352 and a line 356 connected therebetween. The line 356 can be any suitable connection such as, but not limited to, a cable, string, cord, rope or other feature. In use, the fifth pin 350 can be coupled to a suitable attachment point 100 on the central frame member 20 while the sixth pin 352 can be coupled to a suitable attachment point 180 on the frame 160. Proper tension can be applied between the pins 350 and 352 whereby a rotational force can be exerted on the first angled wall engaging assembly 124 that generally encourages the first support frame 160 to rotate around the second pin 320 transferring a rotational force 354 onto the angled wall 70 further maintaining the first support tube assembly 108 in a stable position and assisting in leveraging force toward the angled wall 70 while the hinge arm tool 50 urges the carpet 60 toward the straight wall 80 further stretching and removing any waves in the carpet 60.

A second torque applying assembly 358 includes a seventh pin 360, an eighth pin 362 and a line 366 connected therebetween. The line 366 can be any suitable connection such as, but not limited to, a cable, string, cord, rope or other feature. In use, the seventh pin 360 can be coupled to a suitable attachment point 100 on the central frame member 20 while the sixth pin 362 can be coupled to a suitable attachment point 280 on the frame 260. Proper tension can be applied between the pins 360 and 362 whereby a rotational force can be exerted on the second angled wall engaging assembly 224 that generally encourages the second support frame 260 to rotate around the fourth pin 340 transferring a rotational force 364 onto the angled wall 70 further maintaining the second support tube assembly 208 in a stable position and assisting in leveraging force toward the angled wall 70 while the hinge arm tool 50 urges the carpet 60 toward the straight wall 80 further stretching and removing any waves in the carpet 60.

The hinge arm tool 50 can include a telescoping leg assembly 380, a pivot arm assembly 382 and a carpet engaging pad 384. The pivot arm assembly 382 can have a pivot arm 386 and an urging arm 388. The carpet engaging pad 384 can include a rigid block member 390 having carpet engaging protrusions 392 on a bottom face that are configured to grip the carpet 60. The telescoping leg assembly 380 generally includes a first leg 396 and a second leg 398. Pivoting of the pivot arm 386 causes the first and second legs 396 and 398 to move axially away from each other causing opposing forces 400 and 402 between the carpet 60 and the central frame member 20. In particular, a toggle foot 410 pivotally coupled to the second leg 398 by a ninth pin 420 urges against the central wall 106 of the central frame member causing the central frame member 20 to transfer the force through the first and second support tube assemblies 108 and 208 and ultimately against the angled wall 70. Wheels 430 can be rotatably coupled to the toggle foot 410 for assisting in traversing the hinge arm tool 50 along the central frame member 20 between carpet stretching events.

During the pivoting of the pivot arm 386, creating the forces 400 and 402, the forces communicated along the first and second support tube assemblies 108 and 208 and ultimately against the angled wall 70 will create forces FA1, FA2, FA3, and FA4 onto the carpet 60 generally toward the angled wall 70 and forces FB1 and FB2 onto the carpet 60 generally toward the straight wall 80 removing any waves along a vast area of carpet. In particular, as the first and second support tube assemblies 108 and 208 span a distance along the angled wall 70 generally outboard of the hinge arm tool 50 and distribute significant gripping action across the carpet 60 along the angled wall 70, the carpet installation tool 10 provides improved and efficient stretching of carpet between angled walls. Additionally, the central frame 20 creates a virtual wall for leveraging forces between the central frame 20 and the angled wall 70 and between the central frame 20 and the straight wall 80 resulting in more efficient and even stretching along a wide span of carpet between non-parallel walls.

Figure 2:
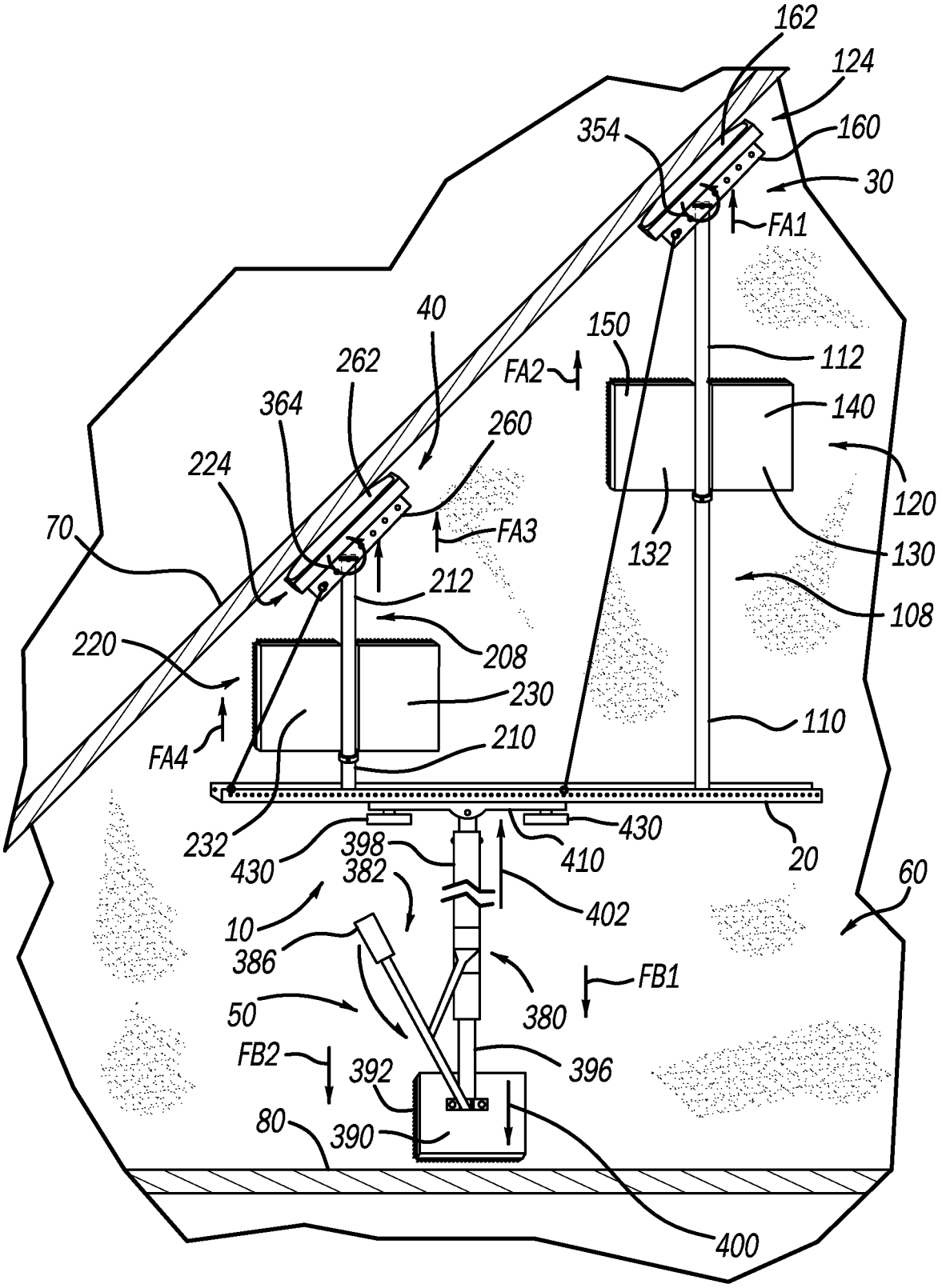
FIG. 2 is a top view of a carpet installation tool assembly shown during installation onto a floor in a room having unparallel opposing walls as depicted in FIG. 1 and shown at a second area for stretching carpet at a second location.

As shown in FIG. 1, the hinge arm tool 50 is positioned generally at a first location. Moving to FIG. 2, the hinge arm tool 50 is moved to a different location along the central frame member 20 to urge a different area of carpet 60. It is appreciated that the forces FA1-FA4 generally remain while the forces FB1 and FB2 are generated at a different location along the straight wall 80. It is further appreciated that while FIG. 1 and FIG. 2 shown two locations of operation, the carpet installation tool 10 as a whole, and/or the first tube support assembly 108, second tube support assembly 208 individually, can be moved as needed along the respective walls 70 and 80 to progressively tighten the carpet 60.

It will be appreciated that the attachment points 100, 180 and 280 are shown and described as bores however other structures and/or mechanisms for selectively securing respective tubes 110, 112, 210 and 212 to the central frame member 20 and frames 160 and 260 may be used.

Figure 7:
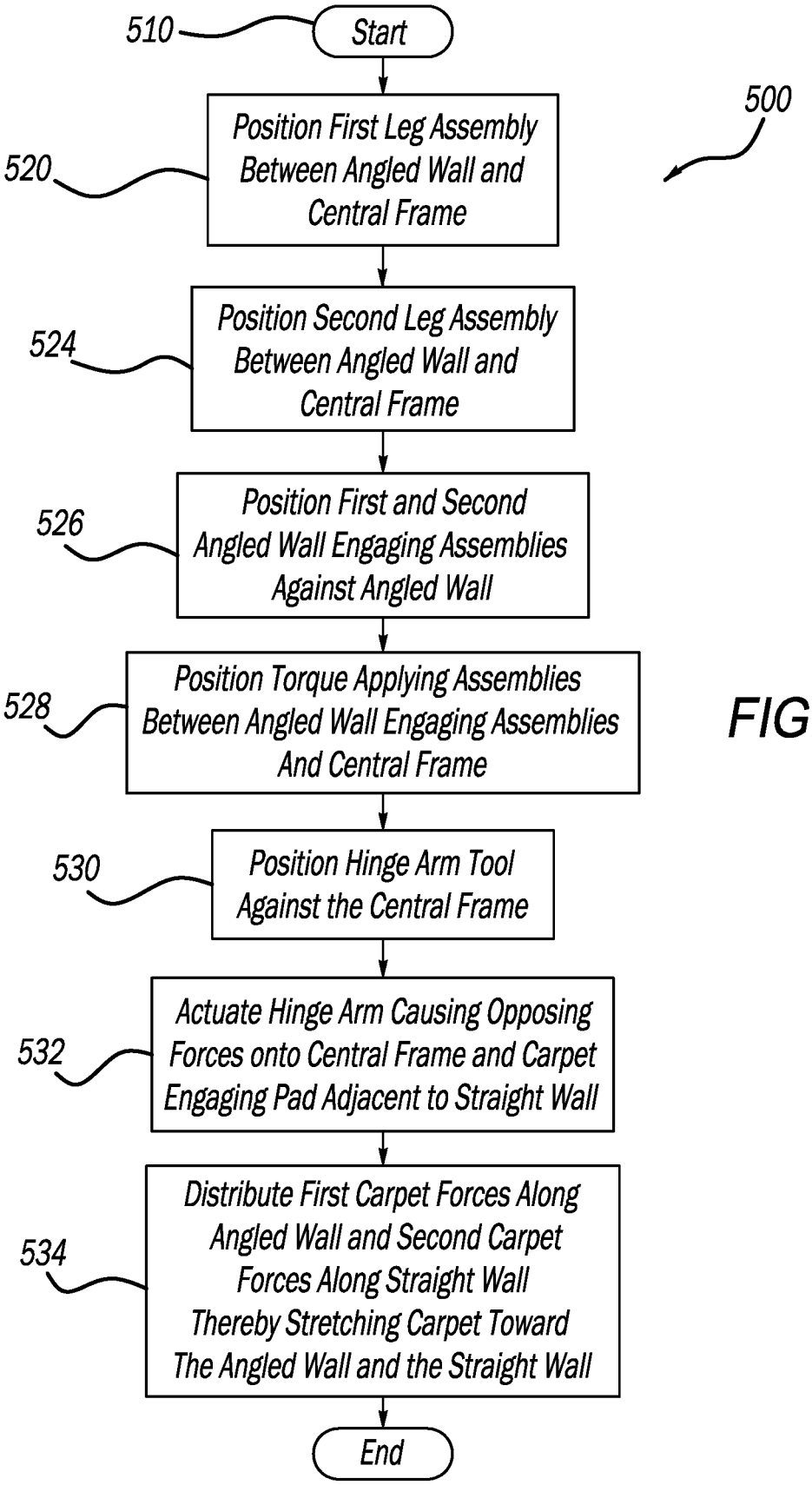
FIG. 7 is an exemplary method of using the carpet installation tool assembly for installing carpet between non-parallel walls according to one example of the present disclosure.

Turning now to FIG. 7, an exemplary method of using the carpet installation tool assembly is generally identified at reference 500 and will be described according to a first example. The method starts at 510. At the outset, all components of the carpet installation tool assembly are arranged along the floor between the two non-parallel walls. The desired distances are selected for the first and second tube support assemblies to sufficiently span a desired distance between the respective first and second angled wall engaging assemblies and the central frame. In examples, the carpet 60 can be initially coupled to the floor (e.g. tack strips, other fastening means, etc.) adjacent to the first wall 70. The first wall 70 can generally be referred to as the set wall where the carpet 60 is initially set. At step 520, the first leg positioning assembly 30 is positioned between the angled wall 70 and the central frame 20. At 524, the second leg positioning assembly 40 is positioned between the angled wall 70 and the central frame 20 generally laterally offset relative to the first leg positioning assembly 30. Once the first and second leg positioning assemblies 30 and 40 are positioned, a virtual wall is created at the central frame 20. In examples, the virtual wall can be generally parallel to the second wall 80 from which forces can bear against. At 526, the first and second angled wall engaging assemblies 124 and 224 are positioned against the angled wall 70. At 528, the torque applying assemblies 344 and 358 are positioned between the angled wall engaging assemblies 123 and 224 and the central frame 20. At 530, the hinge arm tool 50 is positioned against the central frame. At 532, the hinge arm 386 of the hinge arm tool 50 is actuated causing opposing forces onto the central frame 20 and carpet pad 384 adjacent to the straight wall 80. At 534, first carpet forces are distributed along the angled wall 70 generally at FA1-FA4 and second carpet forces are distributed along the straight wall 80 generally at FB1-FB2 thereby stretching the carpet 60 toward the angled wall 70 and the straight wall 80. This process is replicated as needed by moving the hinge arm tool 50 along the central frame 20, and/or by moving either of the first and second leg assemblies along the central frame 20, and/or by moving the entire carpet installation tool assembly 10 along the respective walls 70 and 80 until sufficient stretching of the carpet 60 is achieved and the opposing sides of carpet 60 near the walls 70 and 80 are attached to the floor such as by the tack strips provided at the respective walls 70 and 80.

The carpet installation tool assembly 10 can have many additional uses such as extended length rooms including banquet halls. In other examples, the carpet installation tool assembly 10 can be particularly advantageous using in rooms with baseboard heat including hotels, churches and offices. Additionally, pattern match stretch applications or other situations where a stretch bearing wall is needed including funeral homes, corridors and other unique floorplans. The carpet installation tool assembly 10 can be anchored in wood floors and used with gripper boards, anchors and weights where needed to stretch and manipulate very large (such as 7 foot or more) pattern matched installations.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A carpet installation tool assembly configured to stretch carpet between two non-parallel walls, the carpet installation tool assembly comprising:

a first leg positioning assembly comprising:

a first tube support assembly having a first tube and a second tube, wherein one of the first and second tubes moves axially relative to the other of the first and second tubes during a locating step; and a first angled wall engaging assembly pivotally coupled to the first tube support assembly and that is configured to engage the angled wall during a carpet stretching event;

a second leg positioning assembly comprising;

a second tube support assembly having a third tube and a fourth tube, wherein one of the third and fourth tubes moves axially relative to the other of the third and fourth tubes during a locating step; and a second angled wall engaging assembly pivotally coupled to the second tube support assembly and that is configured to engage the angled wall during a carpet stretching event;

a central frame member, wherein the first and second leg positioning assemblies are selectively coupled at laterally offset locations on the frame member; and a hinge arm tool having a pivot arm, a foot and a carpet pad, the foot arranged at a first end that positions against the central frame member and a carpet pad arranged at an opposite end that engages carpet near the straight wall, the hinge arm tool having a telescoping leg assembly that creates opposing forces onto the central frame member and the carpet pad upon actuation of the pivot arm;

wherein actuation of the pivot arm creates (i) a plurality of first carpet forces along and toward the angled wall proximate the first and second angled wall engaging assembly and (ii) a plurality of second carpet forces along and toward the straight wall proximate the carpet pad thereby distributing a carpet stretching action across the carpet between the angled and straight walls.

2. The carpet installation tool assembly of claim 1, further comprising:

a first torque applying assembly having a first end selectively coupled to the central frame and a second end selectively coupled to the first angled wall engaging assembly, the first torque applying assembly applying tension between the central frame and the first angled wall engaging assembly urging a rotating action of the first angled wall engaging assembly into the angled wall.

3. The carpet installation tool assembly of claim 2, further comprising:

a second torque applying assembly having a first end selectively coupled to the central frame and a second end selectively coupled to the second angled wall engaging assembly, the second torque applying assembly applying tension between the central frame and the second angled wall engaging assembly urging a rotating action of the second angled wall engaging assembly into the angled wall.

4. The carpet installation tool assembly of claim 1 wherein:

the first tube support assembly further comprises a first locking collar that selectively locks the first and second tubes from axially moving relative to each other; and the second tube support assembly further comprises a second locking collar that selectively locks the third and fourth tubes from axially moving relative to each other.

5. The carpet installation tool assembly of claim 1, further comprising:

a first lateral support block assembly comprising:

a first gripping block and a second gripping block configured to position laterally against the first tube support assembly and inhibit lateral movement of the first tube support assembly, the first and second gripping blocks each having carpet engaging protrusions on a bottom face configured to grip the carpet; and a second lateral support block assembly comprising:

a third gripping block and a fourth gripping block configured to position laterally against the second tube support assembly and inhibit lateral movement of the second tube support assembly, the third and fourth gripping blocks each having carpet engaging protrusions on a bottom face configured to grip the carpet.

6. The carpet installation tool assembly of claim 1 wherein the first angled wall engaging assembly comprises:

a first support frame rigidly affixed to a first bumper, the first support frame comprising a plurality of attachment points along a length thereof, wherein the first tube support assembly is selectively coupled to one of the attachment points.

7. The carpet installation tool assembly of claim 6 wherein the first support frame comprises a C-frame.

8. The carpet installation tool assembly of claim 1 wherein the second angled wall engaging assembly comprises:

a second support frame rigidly affixed to a second bumper, the second support frame comprising a plurality of attachment points along a length thereof, wherein the second tube support assembly is selectively coupled to one of the attachment points.

9. The carpet installation tool assembly of claim 8 wherein the second support frame comprises a C-frame.

10. The carpet installation tool assembly of claim 1 wherein the central frame member comprises a C-frame having a plurality of attachment points along a length thereof, wherein the first tube support assembly is coupled to a first attachment point of the plurality of attachment points and wherein the second tube support assembly is coupled to a second attachment point of the plurality of attachment points.

11. The carpet installation tool assembly of claim 10 wherein the foot of the hinge arm tool is configured to be positioned along the central frame at an intermediate position between the first and second tube support assemblies.

12. A method of installing carpet in a room having non-parallel walls including an angled wall and a straight wall, the method comprising:

providing a carpet installation tool assembly comprising:

a first leg positioning assembly comprising:

a first tube support assembly having a first tube and a second tube, wherein one of the first and second tubes moves axially relative to the other of the first and second tubes during a locating step; and a first angled wall engaging assembly pivotally coupled to the first tube support assembly and that is configured to engage the angled wall during a carpet stretching event;

a second leg positioning assembly comprising;

a second tube support assembly having a third tube and a fourth tube, wherein one of the third and fourth tubes moves axially relative to the other of the third and fourth tubes during a locating step; and a second angled wall engaging assembly pivotally coupled to the second tube support assembly and that is configured to engage the angled wall during a carpet stretching event;

a central frame member, wherein the first and second leg positioning assemblies are selectively coupled at laterally offset locations on the frame member; and a hinge arm tool having a pivot arm, a foot and a carpet pad, the foot arranged at a first end that positions against the central frame member and a carpet engaging pad arranged at an opposite end that engages carpet near the straight wall, the hinge arm tool having a telescoping leg assembly that creates opposing forces onto the central frame member and the carpet engaging pad upon actuation of the pivot arm;

positioning the first leg positioning assembly between the angled wall and the central frame;

positioning the second leg positioning assembly between the angled wall and the central frame;

positioning the first and second angled wall engaging assemblies against the angled wall;

positioning the hinge arm tool against the central frame;

actuating the hinge arm causing opposing forces onto the central frame and the carpet engaging pad thereby distributing first carpet forces along the angled wall and second carpet forms along the straight wall thereby stretching the carpet toward the angled wall and the straight wall.

13. The method of claim 12, further comprising:

positioning a first torque applying assembly having a first end selectively coupled to the central frame and a second end selectively coupled to the first angled wall engaging assembly, the first torque applying assembly applying tension between the central frame and the first angled wall engaging assembly urging a rotating action of the first angled wall engaging assembly into the angled wall.

14. The method of claim 12, further comprising:

positioning a second torque applying assembly having a first end selectively coupled to the central frame and a second end selectively coupled to the second angled wall engaging assembly, the second torque applying assembly applying tension between the central frame and the second angled wall engaging assembly urging a rotating action of the second angled wall engaging assembly into the angled wall.

15. The method of claim 12, further comprising:

providing a first lateral support block assembly comprising:

a first gripping block and a second gripping block configured to position laterally against the first tube support assembly and inhibit lateral movement of the first tube support assembly, the first and second gripping blocks each having carpet engaging protrusions on a bottom face configured to grip the carpet;

a second lateral support block assembly comprising:

a third gripping block and a fourth gripping block configured to position laterally against the second tube support assembly and inhibit lateral movement of the second tube support assembly, the third and fourth gripping blocks each having carpet engaging protrusions on a bottom face configured to grip the carpet;

positioning the first and second gripping blocks on opposite sides of the first tube support assembly thereby resisting lateral movement of the first tube support assembly; and positioning the third and fourth gripping blocks on opposite sides of the second tube support assembly, thereby resisting lateral movement of the second tube support assembly.

* * * * *